US007735417B2

(12) United States Patent
Fengler

(10) Patent No.: US 7,735,417 B2
(45) Date of Patent: Jun. 15, 2010

(54) CONDUCTOR IDENTIFICATION SYSTEM

(75) Inventor: Richard R. Fengler, Mesa, AZ (US)

(73) Assignee: The Boeing Company, Chicago, IL (US)

( * ) Notice: Subject to any disclaimer, the term of this patent is extended or adjusted under 35 U.S.C. 154(b) by 596 days.

(21) Appl. No.: 11/405,217

(22) Filed: Apr. 17, 2006

(65) Prior Publication Data

US 2007/0240587 A1 Oct. 18, 2007

(51) Int. Cl.
*B41F 17/10* (2006.01)
*B41F 17/20* (2006.01)

(52) U.S. Cl. ..... 101/35; 101/41; 347/4; 83/678

(58) Field of Classification Search ..... 101/35, 101/41; 40/316; 83/678, 660; 347/4; *B41F 17/10, B41F 17/14, 17/20*
See application file for complete search history.

(56) References Cited

U.S. PATENT DOCUMENTS 4,503,437 A * 3/1985 Katzschner ..... 347/43
4,655,129 A * 4/1987 Wirth et al. ..... 101/35
2005/0162451 A1* 7/2005 Suzuki et al. ..... 347/12
2007/0242308 A1* 10/2007 Michaelson ..... 358/1.18

FOREIGN PATENT DOCUMENTS

CA 2351678 A1 * 12/2002
JP 01249348 A * 10/1989
JP 05200978 A * 8/1993
JP 07282658 A * 10/1995

OTHER PUBLICATIONS

RD340076A, Aug. 1992.*

* cited by examiner

*Primary Examiner*—Leslie J Evanisko

(57) ABSTRACT

A fiber optics/electrical conductors identification system including a printer adapted to receive generically colored (non-colored) heat shrink tubing and include printing capabilities for printing selective color indicia and/or selective alphanumeric indicia and/or bar code symbology and/or the like onto the tubing. A controller may be coupled to the printer to control the printer in order to selectively apply the indicia onto desired length segments of the tubing. It may further include the provision of length-way perforations to assist in tear away (without the use of tools) removal of selective segments of the tubing pieces.

8 Claims, 3 Drawing Sheets

CONDUCTOR IDENTIFICATION SYSTEM

TECHNICAL FIELD

Embodiments of the invention relate to a system for applying identification indicia on tube segments which in turn are applied to fiber optics/electric conductors.

BACKGROUND

As an example, a plurality of electricity conducting wires are coupled together to form a harness. This coupling together of wires is recognized as an aid for electrically connecting components where such connecting requires a plurality of wires. Because, typically, the wires must be accurately connected to the proper contacts, individual wires are e.g. color coded to avoid the occurrence of an assembler incorrectly connecting wires to the wrong contacts. This same consideration may apply to fiber optics conductors and hereafter reference to "conductors" encompasses both fiber optics and electric conductors.

Additionally, the individual wires may be provided with supplemental coding in the form of bar code symbology and/or alphanumeric identification as may be desired by individual systems manufacturers. Thus, it is a common practice for a systems manufacturer to stock multiple sizes and colors of heat shrink tubing, and then individually print identification numbers on the selected tube segments as needed, for subsequent application to individual wires. This practice involves the stocking of numerous different colored tubing followed by time-consuming printing of such colored tubing and is a significant cost addition to the assembly process.

BRIEF DESCRIPTION OF EMBODIMENTS OF THE INVENTION

An embodiment of the invention comprises the application of identification indicia, both color and alphanumeric printing indicia, in a single automated procedure. A systems manufacturer may stock a common generic color of heat shrink tubing e.g. white, and via the use of a printer, apply both color and numerical coding to the tubing in a single operation, i.e., a printing operation.

It is contemplated that for some embodiments, a single printer having, e.g., four colored roll media which may apply to a wide range of color printing using a thermal transfer ribbon printing process to the tube segments, which then are applied to fiber optics or electrically conductive wires that are to be included in a wire harness/bundle. For example, the colored ink of the media vessels may be black, cyan, magenta, and yellow with the latter three colors selectively intermixed via the PANTONE COLOR CODE SYSTEM, to accommodate a wide range of colors and, in particular, the colors of the RESISTOR COLOR CODE SYSTEM known to the electronics industry.

Additionally, for some embodiments, the printer may be equipped with a perforating implement, e.g., a perforating wheel, for axial perforation of selected tube segments during the printing procedure. Such axial or length-way slitting/cutting may enable an assembler to sever/remove those tube segments that are undesired following installation/assembly.

It is further contemplated that for some embodiments, instead of or in addition to the printing of visual indicia onto the tube segments, microchips containing the desired coded indicia may be embedded into the tube segments to be identified by reading/decoding, scanning instrumentation.

The invention will be more fully appreciated upon reference to the following detailed description of various embodiments, having reference to the accompanying drawings.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that alternate embodiments may be practiced with only some of the described aspects. For purposes of explanation, specific materials and configurations are set forth in order to provide a thorough understanding of the illustrative embodiments. However, it will be apparent to one skilled in the art that alternate embodiments may be practiced without the specific details. In other instances, well-known features are omitted or simplified in order not to obscure the illustrative embodiments.

The phrase "in one embodiment" may be used repeatedly. The phrase generally does not refer to the same embodiment; however, it may. The terms "comprising," "having," and "including" are synonymous, unless the context dictates otherwise.

The phrase "A/B" means "A or B." The phrase "A and/or B" means "(A), (B), or (A and B)." The phrase "at least one of A, B and C" means "(A), (B), (C), (A and B), (A and C), (B and C) or (A, B and C)." The phrase "(A) B" means "(B) or (A B)," that is, A is optional.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

Figure 1:
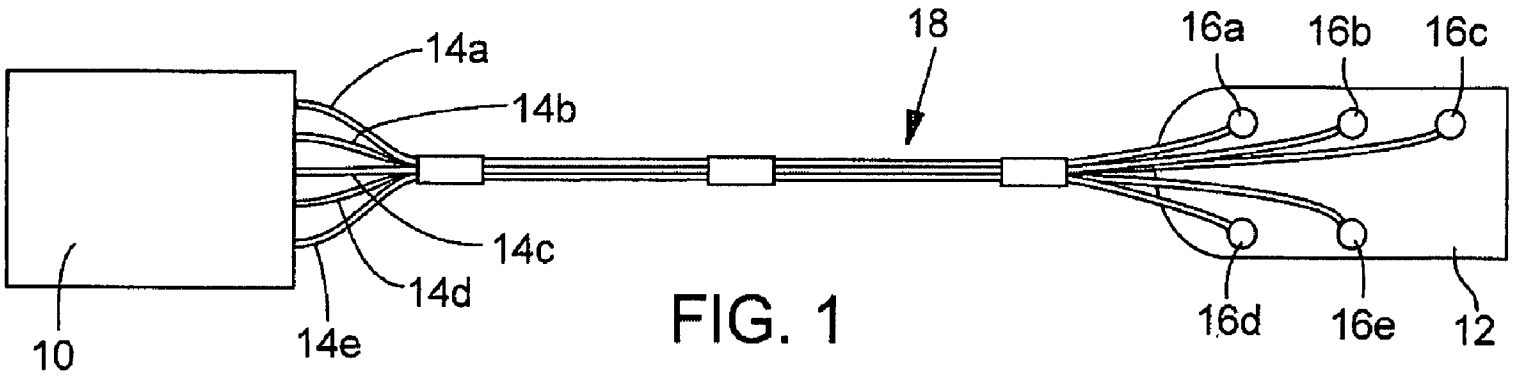
FIG. 1 is a schematic illustration of an application for a system of this invention, in accordance with various embodiments.

FIG. 1 illustrates a conductor identification system in accordance with an embodiment of the present invention.

Source 10 may be adapted to generate electric signals directed to a receiving component 12, which is designed to react to the signals for performing desired tasks. Conductive wires 14 *a-e* conduct the various signals of source 10 to interconnected contacts 16 *a-e* provided on component 12. The multiple wires are commonly bundled together and referred to as a harness or conduit as illustrated at 18. Accordingly, it is desirable that the wires 14 *a-e* are properly marked so that an assembler will know which of the wires 14 *a-e* to connect to which of the contact 16 *a-e*. Typically the wire are color coded for this task. One color coding that is commonly used is identified and known to the industry as the Resistor Color Code. (However the communications industry uses a more complex coding scheme, and this and other coding schemes are encompassed by the invention.) It is often additionally desired that other information be applied to the conductors, e.g., in the form of number and/or letter codes (alphanumeric), and/or bar code symbology 52, and/or RFID (radio frequency identification devices), capsules/chips devices 54, and the like.

Figure 3:
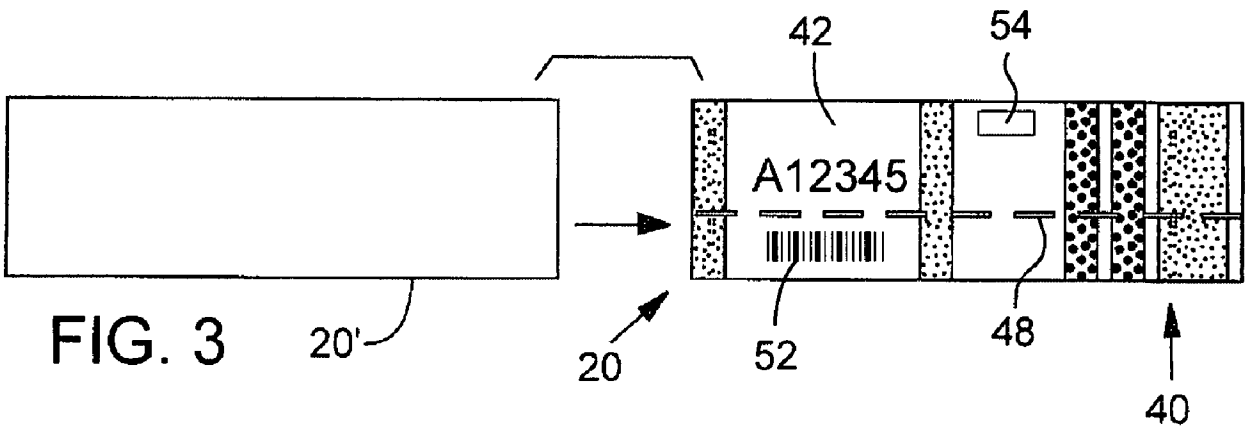
FIG. 3 illustrates a tube segment both before and after receiving the coded indicia, in accordance with various embodiments of the invention.
Figure 5:
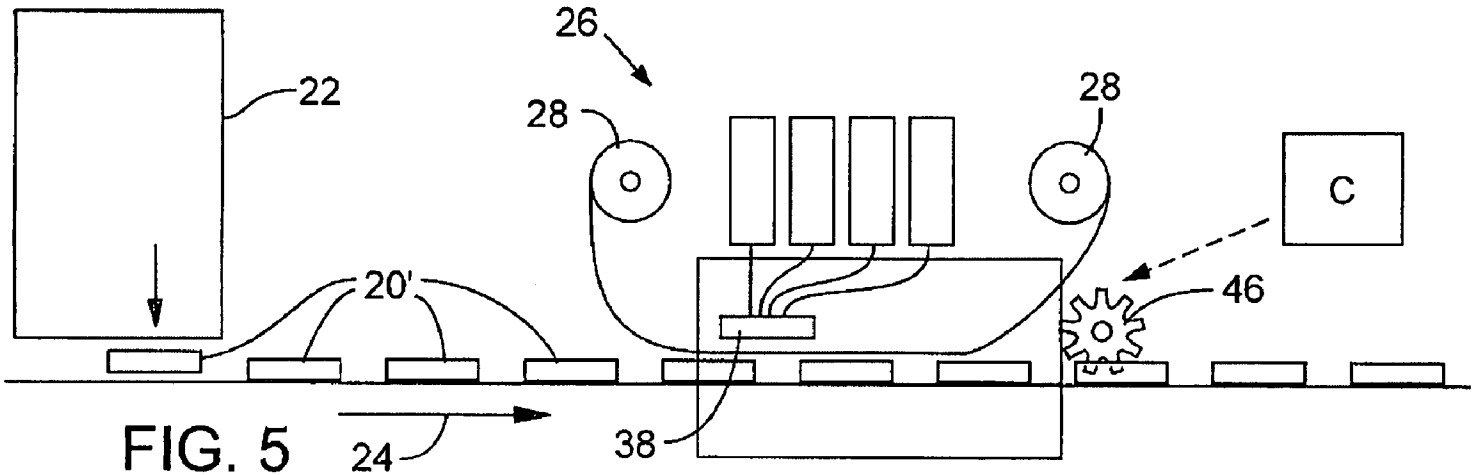
FIG. 5 illustrates a thermal transfer printing operation in accordance with various embodiments of the invention.
Figure 7:
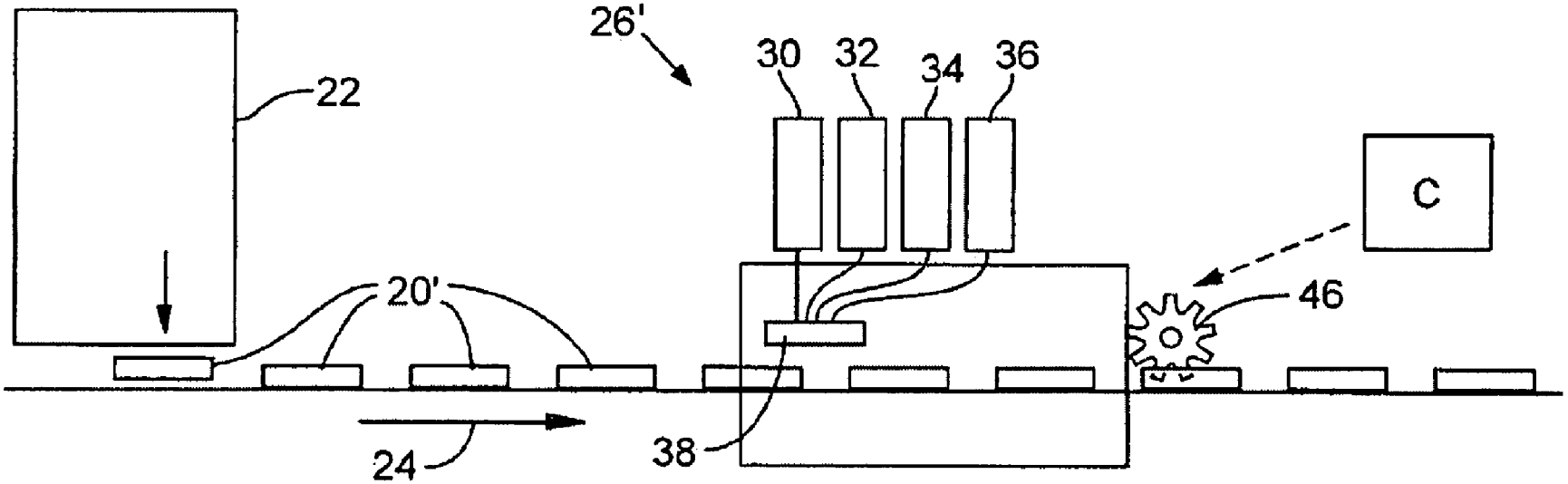
FIG. 7 illustrates an ink jet printing operation in accordance with various embodiments of the invention.

FIG. 5 illustrates an electrical conductor identification system in accordance with an embodiment of the present invention. As illustrated, tube segments 20', e.g., 1½" lengths and all having a common color, e.g., basic or generic white, may be provided from a common source as indicated schematically at 22. The tube segments 20' may be conveyed (as indicated at 24) to a thermal transfer ribbon printer 26. As schematically shown, thermal transfer ribbon is fed through printer between rolls 28. Thermal transfer ribbon printers currently available on the market can be modified to perform the task of this invention. A known such printer is Toshiba TEC CB-416 that is color capable and has a four-head printing capability. The Toshiba TEC CB-416 printer may be modified to provide feeding and color printing of the tube segments 20'. Further is the provision of selective color printing. Referring to FIG. 7, shown is an ink jet printer 26' wherein color ink may be provided by color media vessels 30, 32, 34, and 36. Vessel 30 may contain the color black and vessels 32-36 the colors cyan, magenta, and yellow. These vessels 32-36 may be selectively intermixed in accordance with the PANTONE COLOR CODE whereby a vast array of print colors can be produced. In the thermal transfer ribbon printer 26 arrangement shown in FIG. 5 and the ink jet printer 26' arrangement shown in FIG. 7, a printer head 38 may be capable of printing e.g. a color frame or band 40 and/or an alphanumeric code 42 as shown in FIG. 3. A controller/computer C may be programmed to produce the desired operation of the printer head 38.

It will be appreciated that the printer 26 can be programmed to apply a desired vessel 40 and in the same operation apply an alphanumeric code 42. Alternatively the printer head may be devised and programmed to apply a number code 42 of a selected color to achieve substantially the same result, i.e., a tracking number printed in a color coded print. Further it may be devised/programmed to provide bar code symbology 52 and/or RFID/microchip devices 54.

Figure 2:
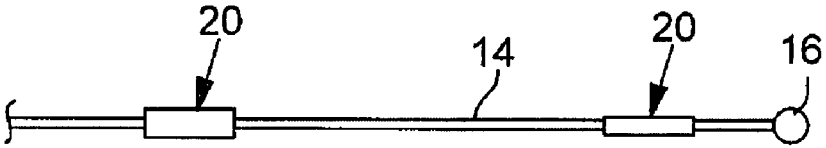
FIG. 2 illustrates a conductive wire on which heat shrink tube segments are applied in accordance with various embodiments of the invention.
Figure 6:
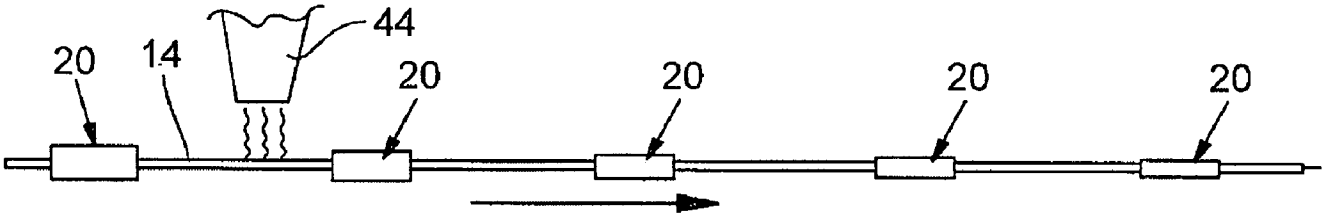
FIG. 6 illustrates application of the tube segments onto a conductive wire, in accordance with various embodiments.

Following the application of the color and/or number code, the coded tube segments may be applied to the wire 14 as illustrated in FIG. 6. The oversized coded tube segment 20 may be placed on the wire and a heat source 44 applies heat (infrared, convection, conduction etc.) to the tubing which results in the shrinking of the tubing for desired securement to the wire 14. FIG. 2 further shows a comparison of tubing segments 20 before and after shrinking onto wire 14 terminating at contact 16.

Whereas the identification provided by the tube segment 20 is highly desired for assembly and particularly at the wire end to be connected to the contacts of the component 12, it is also desirable upon assembly completion that at least the tubing segments at the end be removed. (The intermediate tube segments may preferably be left on the wire 14 for subsequent troubleshooting.)

Figure 4:
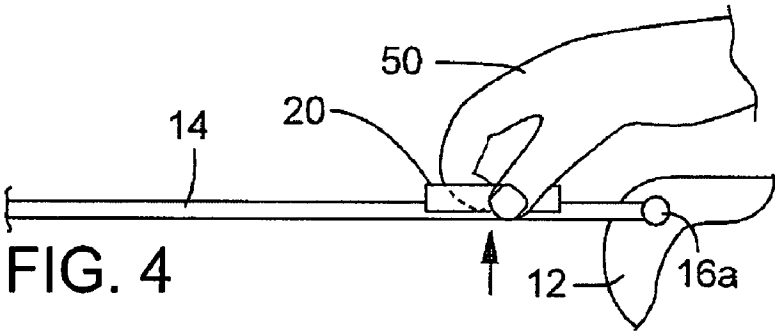
FIG. 4 illustrates removal of a selected tube segment from the end of a wire following connection, in accordance with various embodiments.

To facilitate removal of selective tube segments, such selective segments may be perforated. From FIG. 5, a perforating wheel 46 may be mounted adjacent to or as part of the printer 26. This wheel 46 may be operated, e.g., via a solenoid or stepper motor for selectively applying axially directed perforations 48 as illustrated in FIG. 3. With the application of such perforations, an assembler 50 may simply pinch the tube segment 20 in a tear away operation as illustrated in FIG. 4, i.e., without the use of tools. Perforating wheels capable of providing the perforations as proposed herein are available from a number of sources.

It would be appreciated that whereas the printing operation of FIG. 5 is indicated to provide identifying indicia to tube segments one at a time sequentially through the printer, such printers may also include multiple printing heads capable of independent color and number/word printing whereby multiple lines of tube segments can be fed through the printer simultaneously. Also, it will be appreciated that instead of applying an alphanumeric code to the tube segments, the segments may be embedded with microchips that can be detected by "external" instrumentation. This may be particularly beneficial for troubleshooting, i.e., allowing a troubleshooter to quickly find the specific wire among a plurality of wires in a bundle.

The invention is considered to provide a significant cost saving benefit in the coding of multiple wire conductors. Those skilled in the art having the information provided herein will be readily able to produce the described embodiment of the invention as well as further enhancements and modifications. Accordingly, the terms of the claims appended hereto are intended to be broadly interpreted in accordance with the usage of such terms in the art and thereby encompass such enhancements and/or modifications.

What is claimed is:

1. A conductor identification system comprising:

a printer adapted to receive heat shrink tubing for heat shrink securement to fiber optics/electric conductors, the tubing being of common stock and non-color coded, the printer further having printing capabilities for applying selective color coded identification indicia onto separated or non-separated segments of the tubing;

a controller coupled to the printer to controllably apply said indicia to said segments of the tubing; and a perforating wheel being coupled to the printer for forming a plurality of perforations in at least one of the tubing segments, the perforating wheel being oriented to form the plurality of perforations in a length-wise direction along a length of the tubing segment in a manner to enable tear-away removal of the tubing segment from the conductor.

2. The conductor identification system as defined in claim 1 wherein said tube segments are white, and said printer is adapted to print a color pattern onto the white tube segments as at least a part of said selective identification indicia.

3. The conductor identification system as defined in claim 2 wherein said printer is further adapted to additionally and concurrently print alphanumeric indicia onto said multiple tube segments as a further part of said identification indicia.

4. The conductor identification system as defined in claim 3 wherein the printer is adapted to use thermal transfer ribbon to apply said identification indicia.

5. The conductor identification system as defined in claim 2 wherein the system further comprises at least three color ink vessels coupled to the printer and the controller, and said controller controlling the color ink vessels to produce selective intermixture of the color inks to produce multiple colors in accordance with a standardized color code.

6. The conductor identification system as defined in claim 2 wherein the system further comprises at least three sources of color media coupled to the printer and the controller, and said controller controlling the sources of color media to produce selective intermixture of the colors to produce multiple colors in accordance with a standardized color code.

7. The conductor identification system as defined in claim 1 wherein said printer is further adapted to apply identification indicia in the form of bar code symbology.

8. The conductor identification system as defined in claim 1 wherein said printer is further adapted to apply radio frequency identification devices and/or microchips.

* * * * *